US007257499B2

(12) United States Patent
Maier

(10) Patent No.: US 7,257,499 B2
(45) Date of Patent: Aug. 14, 2007

(54) METHOD AND APPARATUS FOR DETERMINING A FREQUENCY FOR THE SAMPLING OF AN ANALOG SIGNAL

(75) Inventor: Martin Maier, Diessen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 11/098,743

(22) Filed: Apr. 4, 2005

(65) Prior Publication Data

US 2005/0179571 A1 Aug. 18, 2005

Related U.S. Application Data

(63) Continuation of application No. PCT/EP03/11559, filed on Oct. 17, 2003.

(30) Foreign Application Priority Data

Nov. 21, 2002 (DE) ..... 102 54 469

(51) Int. Cl.
*G01R 13/02* (2006.01)

(52) U.S. Cl. ..... 702/67; 702/75

(58) Field of Classification Search ..... 702/67, 702/72, 75, 78; 375/375
See application file for complete search history.

(56) References Cited

U.S. PATENT DOCUMENTS

| | | | | |
|---|---|---|---|---|
| 5,255,330 | A | 10/1993 | Huynh et al. | |
| 5,805,233 | A | 9/1998 | West | |
| 6,147,668 | A | 11/2000 | Eglit | |
| 6,268,848 | B1 | 7/2001 | Eglit | |
| 6,313,881 | B1 | 11/2001 | Reinhart et al. | |
| 6,503,195 | B1 * | 1/2003 | Keller et al. | 600/160 |
| 6,731,343 | B2 * | 5/2004 | Yoneno | 348/537 |
| 2002/0158814 | A1 * | 10/2002 | Bright et al. | 345/7 |
| 2003/0185332 | A1 * | 10/2003 | Cheng | 375/376 |
| 2005/0123052 | A1 * | 6/2005 | Rabinowitz et al. | 375/240.24 |

FOREIGN PATENT DOCUMENTS

| | | | |
|---|---|---|---|
| DE | 199 40 384 | A1 | 3/2001 |
| EP | 0 756 417 | A2 | 1/1997 |
| EP | 0 807 923 | A1 | 5/1997 |
| EP | 0 791 913 | A2 | 8/1997 |
| EP | 0 807 923 | A1 | 11/1997 |

OTHER PUBLICATIONS

English Translation of International Preliminary Examination Report.

* cited by examiner

*Primary Examiner*—John Barlow
*Assistant Examiner*—Anthony Gutierrez
(74) *Attorney, Agent, or Firm*—Thomas, Kayden, Horstemeyer & Risley

(57) ABSTRACT

In a method and an apparatus for determining a frequency for the sampling of an analog signal, which is provided to a digital screen for representing an image on the same, at least two areas succeeding in line direction will be established in the image to be displayed. In each of the established areas, a sample phase will be determined, for which a contrast in the established area is maximum or a minimum. Subsequently, a local course of the sample phase will be determined in the line direction based on the determined sample phases. The sampling frequency will be determined based on a base value and a modification value, which is derived from the local course of the sample phase.

6 Claims, 5 Drawing Sheets

A)

B)

METHOD AND APPARATUS FOR DETERMINING A FREQUENCY FOR THE SAMPLING OF AN ANALOG SIGNAL

CROSS-REFERENCE TO RELATED APPLICATION

This application is a continuation of copending International Application No. PCT/EP03/11559, filed Oct. 17, 2003, which designated the United States and was not published in English.

BACKGROUND OF THE INVENTION

1. Field of the Invention

The present invention relates to a method and an apparatus for determining a frequency for the sampling of an analog image, and, here, in particular, to a method for determining a frequency for the sampling of an analog signal provided to a digital screen, so as to display an image on the digital screen. Further, in particular, the present invention relates to an apparatus for generating digital data from analog image data, so as to display an image based on the generated image data on a digital screen.

2. Description of the Related Art

Conventional computers and/or calculating units include elements, eg graphic cards, so as to provide graphic information generated in the computer, such as eg images, for display on an external device, such as a screen. Based on the digital signals, which are provided by the computer and/or its central processing unit (CPU), the conventionally used graphic cards generate corresponding image data suitable for controlling a screen. In many applications the display device associated with the computer includes the screen, an analog screen, which comprises a cathode ray tube. In order to be able to provide the required data for this case of application, which has been exclusively existing up until a few years ago, the graphic card includes a digital/analog converter, so as to convert the image data generated by the graphic card into an analog signal, eg a RGB signal, which then enables the controlling of the screen. In addition to the analog image data signals (RGB signals), the horizontal and vertical synchronization signals are also output to the screen, which are required for a proper rendition of the image data on the screen.

Recently, however, so-called digital screens have been increasingly used, eg LCD-screens or LCD-monitors (LCD=liquid crystal display), which, in contrast to screens with cathode ray tubes, require digital control. In this case it is necessary to subject an analog video signal applied to a video output of a computer/calculating unit to digital further processing in the screen/monitor. At first, this makes it necessary to digitize the analog video signal once more with a sampling frequency. In order to reconstruct the output data with an as exact a sampling frequency as possible it is therefore desirable to sample the analog signal with the original frequency and with a correct phase position, that is with the frequency and phase position by which the analog video signals were generated from the digital data in the graphic card at the output of the computer. The phase position refers to the displacement of the sample signal relative to the generated sample signal, with the phase position generally being indicated in degrees, eg 0 degrees, which corresponds to no displacement, or 180 degrees, corresponding to a displacement by a half clock period.

FIG. 1 schematically represents the waveform of an analog video signal (see FIG. 1A) at the output of a digital screen. Also represented in FIG. 1B is a sample clock being ideal for the sampling of this applied analog signal. T refers to a period of the sample clock.

While the generation of images on analog screens using the analog video signals generated by the graphic card is generally problem-free and, in particular does not result in any visible artifacts, the repeated sampling of an analog signal based on an original digital signal does represent a problem, since artifacts in the represented image may arise on the basis of the repeated sampling in the digital screen, with these artifacts being visible to the viewer. In order to avoid such artifacts, various approaches are known in the state of the art, which will be set forth briefly below.

For example, in the U.S. Pat. No. 6,268,848, a method is described, by means of which visible errors in an image being displayed on a digital monitor may be avoided in that an automatic sample control system is employed, in which, for sucessive image frames, the image content of which remains essentially the same, a phase of the sample clock, for a repeated sampling of the received analog signal, will be changed until a maximum sample value is reached. The phase value achieved with the maximum sample value will then represent the phase-shift of the sample clock which is optimum for the sampling of this frame.

The U.S. Pat. No. 6,147,668 describes a digital display unit, by means of which display artifacts, which are generated on the basis of the aliasing effects of high-frequent interferences in analog display signals, are avoided and/or minimized. Similar to the U.S. Pat. No. 6,268,848, a modulation is also carried out, so as to provide the sample clock signal with different phase-shifts for successive lines or frames so that, on the basis of this modulation, the analog display signal is sampled for a display on the digital display element at different sample points for the same pixel in different frames.

As may be seen, in the above-described approaches only one sample phase is varied, whereas the sampling frequency remains unchanged. The approaches described in the two US patents above use sample clocks, which are derived based on the horizontal and vertical synchronization signals provided together with the analog video signal. The synchronization signals represent the reference signals for the digital screen, with which a clock generator in the screen and/or in the screen control is locked, so as to generate a suitable sample clock based on the reference signal.

Conventionally, the generation of the reference signal for the clock generator is effected such that, based on the received synchronization signals of the analog signal, access is made to a look-up table, from which a reference value suitable/ideal for this synchronization signals is selected, which will then be provided to the clock generator as a reference clock and/or reference frequency for generating the sample clock.

The above approaches will only function if it is ensured that the synchronization signals and/or the reference signal, which is associated with the analog signal, actually renders the frequency of the digital signal, on the basis of which the analog signal has been generated. In this case the sample clock generated by the clock generator in the digital screen and/or in the control of the same matches this frequency. This marginal condition, however, does not apply for all graphic cards and, as a rule, is only fulfilled for very highly advanced graphic cards. Other graphic cards, eg less expensive graphic cards, comprise tolerances resulting in that the frequency used in the graphic card comprises deviations to the frequency which is signalized to the digital screen as an optimum/ideal sampling frequency. Conventionally, these deviations are in the range from 1% to 5% of the sampling frequency signalized to the screen.

In such cases, the above-described approaches for sampling analog signals in digital screens for avoiding artifacts or interferences in the display of the image are only employable under certain conditions, since, here, a frequency error is present when sampling the analog signal, which requires further correction.

SUMMARY OF THE INVENTION

It is the object of the present invention to provide a method and an apparatus enabling the generation of a sampling frequency for the repeated digitalization of an analog signal, which is well-adapted to the frequency of a digital signal, which was based on the analog signal.

In accordance with a first aspect, the present invention provides a method for determining a frequency for the sampling of an analog signal provided to a digital screen, so as to display an image on the digital screen, the method comprising the following steps: (a) establishing at least two areas in the image to be displayed, which succeed each other in a line direction; (b) determining a sample phase in each of the established areas for which a contrast in the established area is a maximum or a minimum; (c) determining a local course of the sample phase in the line direction based on the sample phases determined in step (b) in the established areas; and (d) determining the sampling frequency based on a base value and a modification value which is derived from the local course of the sample phase which was determined in step (c).

When determining the sample phase in accordance with step (b), a sample phase is determined in each of the established areas with which the best or worst sampling is achieved and with which the contrast in the established area is thus as a maximum or minimum.

In accordance with a second aspect, the present invention provides an apparatus for generating digital data from analog image data, so as to display an image based on the generated image data on a digital screen, the apparatus having: an A/D converter including a data input for receiving the analog image data, a data output for outputting the digital image data and a clock input; a clock generator including a clock output for outputting a clock signal and a control input for receiving a clock frequency control signal; a phase-shifter including a clock input for receiving the clock signal from the clock generator, a clock output for outputting a phase-shifted clock signal at the clock input of the A/D converter, and a control terminal for receiving a control signal which establishes a phase-shift; and a control having an input for receiving the digital data from the A/D converter, a first control output for outputting the clock frequency control signal to the clock generator, and a second control input for outputting the signal establishing the phase-shift to the phase-shifter, with the control means being effective so as to carry out the following steps based on the digital data provided at the input: establishing at least two areas succeeding each other in the line direction in the image to be displayed, determining a sample phase in each of the areas, for which a contrast in the established area is a maximum or a minimum, determining a local course of the sample phase in the line direction based on the determined sample phases, determining the sampling frequency based on a base value and a modification value, which is derived from the local course of the sample phase, and generating the clock frequency control signal corresponding to the determined sampling frequency.

In accordance with a preferred embodiment of the present invention, the sample phase, comprising the maximum or minimum contrast in an established area, is generated in that a plurality of reference values is generated at respective different sample phases and at an identical sampling frequency, with the reference value being defined by the sums of the absolute differences of succeeding intensity values in the established area. From the thus generated reference values, a maximum or minimum reference value will be selected, with a maximum and/or minimum contrast being defined by the maximum and/or minimum reference value.

In accordance with another preferred embodiment of the present invention, the sample phase comprising the maximum or minimum contrast in an established area is generated in that a first measurement in each of the considered areas is carried out at an established sample phase and an established sampling frequency, so as to obtain a first reference value for each of the areas. Then, a second measurement will be carried out in each of the considered areas so as to obtain a second reference value for each of the areas. For each of the considered areas, a difference of the reference values obtained by the first measurement and the second measurement will be generated. This measurement will be carried out at a plurality of various sample phases/phase values, so as to obtain a plurality of difference values. Subsequently, for each of the considered areas, the maximum difference value displaying a minimum contrast or the minimum difference value displaying a maximum contrast will be selected from the plurality of obtained difference values. Alternatively, for each of the areas and for each of the sample phases, any number of measurements may be carried out, on the basis of which several difference values will then be obtained for each area.

In accordance with a first preferred embodiment, the determining of the local course and of the sampling frequency first includes the determining of a straight line running through the determined best or worst sample phases. The slope will then be determined for this straight line. The modification value will then be established based on the slope of the straight line, and the sampling frequency will then be obtained by adding the base value and the modification value, with a sign of the modification value depending on whether the straight line is rising or falling, that is, whether the slope comprises a positive or negative sign. In an alternative embodiment, straight sections and leaps are determined in the course of the sample phases, and the number of leaps in the course will be detected. The modification value then corresponds to the number of leaps, and the sampling frequency will be obtained again by adding the base value and the modification value. In order to determine the sign of the modification value it is to be established, whether the straight sections in the local course are rising or falling.

BRIEF DESCRIPTION OF THE DRAWINGS

These and other objects and features of the present invention will become clear from the following description taken in conjunction with the accompanying drawings, in which.

DESCRIPTION OF THE PREFERRED EMBODIMENTS

In the following, a preferred embodiment of the inventive apparatus will be explained in detail from FIG. 2. Subsequently, with reference to the block diagram represented in FIG. 2, a detailed description of the preferred embodiment of the inventive method will follow.

Figure 1:
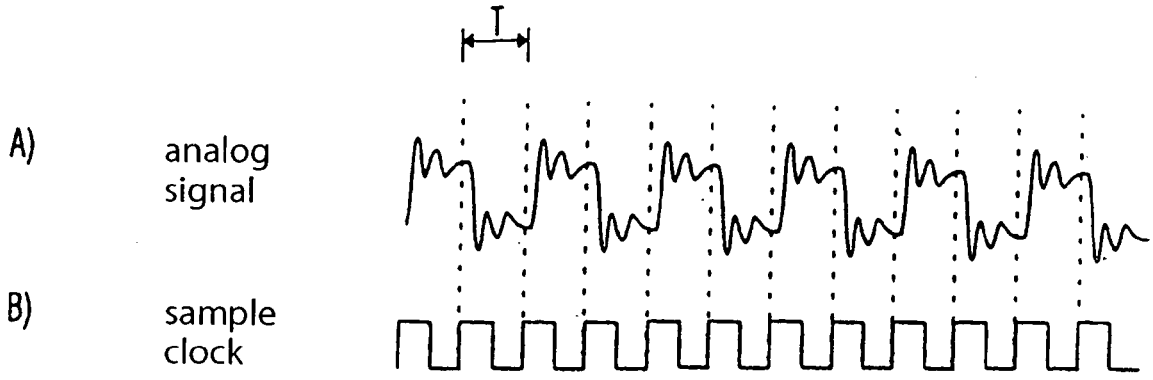
FIG. 1 is the course of an analog signal in FIG. 1A at the input of a digital screen, and a sample clock ideal for sampling the analog input signal in FIG. 1B.
Figure 2:
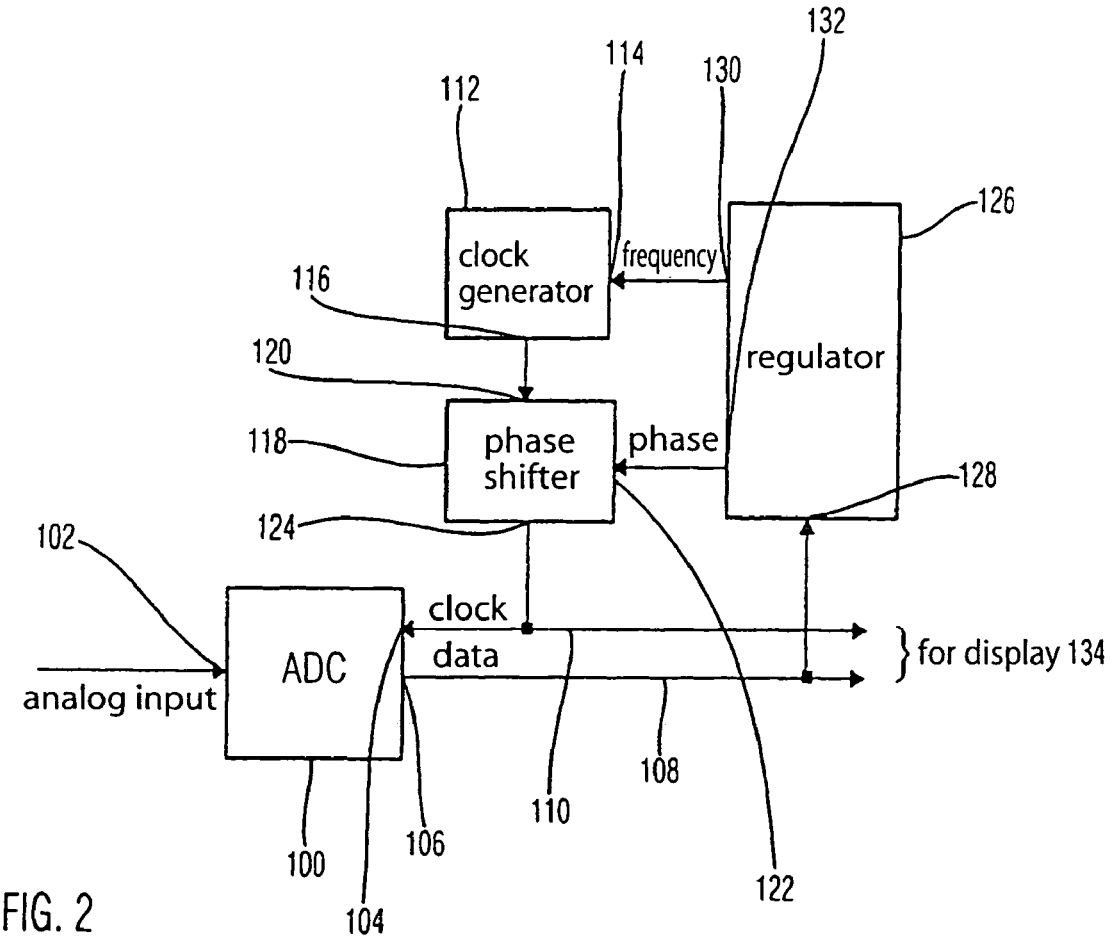
FIG. 2 is a block diagram of an apparatus for generating a sampling frequency in accordance with a preferred embodiment of the present invention.

In FIG. 2, the block diagram of a control means is represented, as it may be used, eg, in the input stage of a digital screen, eg a LCD screen.

The apparatus includes an analog/digital converter (ADC) 100 receiving an analog input signal at an input 102, eg an analog video signal from a graphic card of a computer and/or calculating unit. At a clock input 104, the analog/digital converter 100 receives a clock signal, based on which the analog/digital converter carries out a sampling of the analog signals received at the input 102. The generated digitized signal will then be provided by the analog/digital converter 100 to its data output 106. The data generated by the analog/digital converter 100 will be provided to a data line 108 at the output 106 of the same. The clock signal applied to the clock input 104 of the analog/digital converter 100 will be fed to a clock line 110. The data line 108 and the clock line 110 further extend to the display element of the digital screen, so as to provide the data signals and clock signals required for display to the same.

In accordance with FIG. 2, the arrangement further includes a clock generator 112 receiving a clock frequency control signal at a control input 114. At an output 116 of the clock generator 112 the same outputs a clock signal generated in dependence on a control signal applied to the control input 114.

A phase-shifter 118 is provided, which receives the clock signal generated by the clock generator 112 at an input 120. Further, the phase-shifter 118 comprises a control input 122, where the same receives the control signal, which establishes a phase-shift, with which the clock signal received by the clock generator 112 is to be provided with. The phase-shifted clock signal will then be provided at an output 124 of the phase-shifter. The output of the phase-shifter 124 is connected to the input of the analog/digital converter 100 via the clock line 110.

Further, the apparatus includes a closed-loop/open-loop control 126, which receives the data signal generated by the analog/digital converter at a first input 128 connected to the data line 108. The open-loop control is operative, so as to provide the clock frequency control signal at a first control output 130. Also, the open-loop control 126 is operative, so as to provide, at a second control output 132, the signal for the phase-shifter 118, which establishes the phase shift.

The open-loop control 126 operates in accordance with the inventive method, with the control signals the clock generator and the phase-shifter, which are required for carrying out the inventive method, are eg carried out on the basis of run controls/algorithms implemented in the open-loop control 126. Further, the open-loop control 126 includes a signal processing unit, so as to process and evaluate the data signals received at the input 128.

In the following, a preferred embodiment of the inventive method will be explained in detail with reference to the apparatus represented in FIG. 2.

In the inventive method, as described above, it is assumed that an ideal sampling frequency signalized to the digital screen for re-sampling the analog input signal by the analog/digital converter 100 was not the actual frequency of the digital signal which was the basis of the analog signal. Rather it is to be expected that, on the basis of the tolerances of the graphic card used for generating the analog signal, deviations from the ideal frequency exist in the area of a maximum of 1% to 5%. This deviation makes it necessary to carry out a modification of the ideal sampling frequency, so as to carry out a re-sampling/re-digitalization of the analog input signal such that an image defined by the analog input data may be properly displayed on the digital screen, in particular without any visible errors.

For determining the required frequency for sampling the input data generated by a certain apparatus (graphic card), areas of the analog signals, which repeat themselves, will be viewed in accordance with the invention. As a matter of fact, static frames will be used for the inventive method, and in the same frame, an individual or several screen lines will be viewed. For the inventive method, therefore, the same image/the same frame is preferably provided for a multi-sampling for determining the optimum sampling frequency. Further, it goes that the period of the sample clock provided to the analog/digital converter 100 is an integer divider of the duration of the repetitive area of the analog signal, with the horizontal period being a variable of the pixel period generated by means of a PLL circuit.

By means of the closed-loop and measuring loop represented in FIG. 2 the sampling frequency and also the sample phase may be determined from the digital video data on the data line 108.

The inventive method for determining the sampling frequency relies on a method for determining the best/worst sample phase, but is independent of how this best/worst sample phase is actually determined. For example, for determining the best or worst sample phase, only the U.S. Pat. Nos. 6,268,848 and/or 6,147,668 mentioned in the introductory part of the description may be used, which disclose two approaches for determining the best/worst sample phase. For the frequency determination both a method determining the worst sample phase and a method determining the best sample phase may be used.

In the following description of the preferred embodiments it is assumed that a method is used for the frequency determination which determines the best sample phase. A method based on the determination of the worst sample phase may be employed as an analogy to this.

For carrying out the inventive method, first, a "measurement" (sampling) of the analog data of the stationary frame applied to the input 102 of the analog/digital converter 100 will be carried out with a freely selected sampling frequency. Based on the obtained data signals, a calculation of an error will be effected, which indicates the deviation of the selected sampling frequency to the known ideal sampling frequency (see above). With regard to the freely selected sampling frequency it should be noted that the same may basically be chosen arbitrarily. However, in order to obtain a result within a short period of time than after a short calculation period, the freely selectable sampling frequency is chosen so as to roughly correspond the expected deviation. Preferably, the freely selectable sampling frequency is chosen, so as to correspond to an expected frequency. If, eg, for a graphic card used, deviations from the optimum frequency in the area of ±1% to ±5% are expected, the freely selectable sampling frequency is preferably selected in this area around the optimum sampling frequency.

After the repetitive analog signal area is M sample clocks wide, the sampling frequency may be indicated as M clocks, with M being the number of the pixels per horizontal line of the digital screen in the preferred embodiment.

Figure 3:
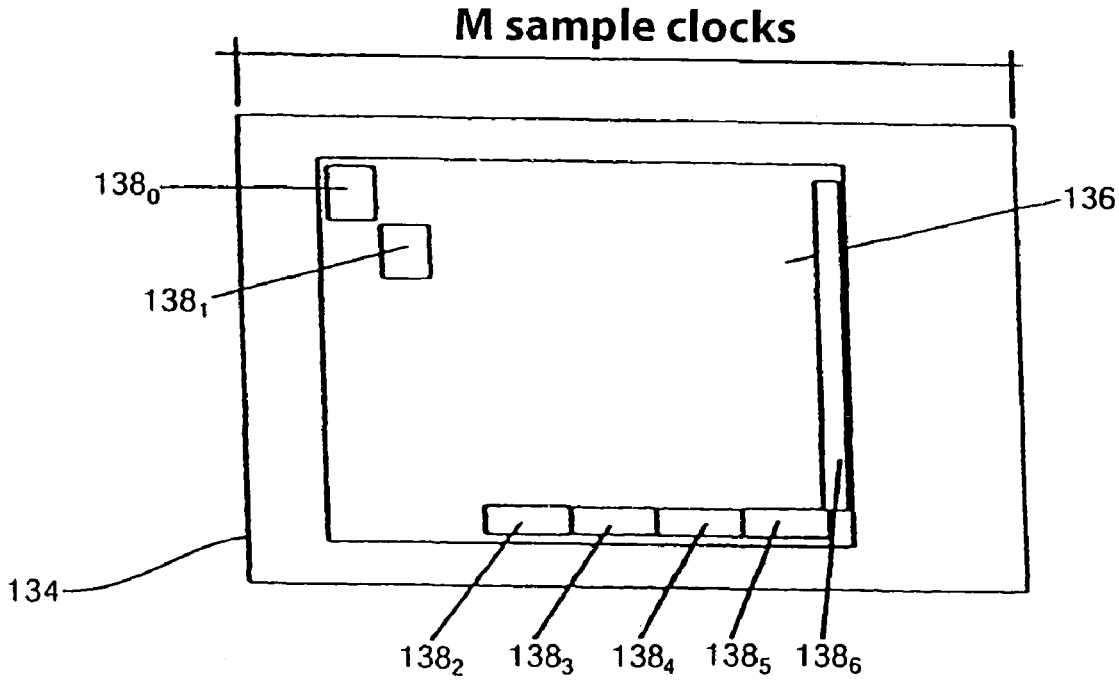
FIG. 3 is a representation of a screen with an active image, in which the plurality of measuring areas being used for the frequency determination in accordance with the present invention are represented.

For frequency determination, that is for determining the actual sampling frequency, a plurality of N areas (N≧2) will now be selected in the active screen area. In FIG. 3, a screen is represented representing an active image in which a plurality of measuring areas are shown.

FIG. 3 schematically shows the display area 134 of the digital screen which, as described above, is M pixel wide, that is comprises M pixel in each horizontal line. Further, in FIG. 3, an active image 136 represented on the screen 134 is shown. In the active image 136 a plurality of measuring areas $\mathbf{138}_0$ to $\mathbf{138}_6$ are shown. These areas $\mathbf{138}_0$ to $\mathbf{138}_6$ will be used for frequency determination. In these areas, the best sample phase will be determined, as will still be described below. In the embodiment shown in FIG. 3, seven areas $\mathbf{138}_0$ to $\mathbf{138}_6$ are shown, with the present invention, however, not being limited to this number. In fact it is sufficient, if at least two areas are selected, with the accuracy, however, increasing with the increasing number of the selected areas. The areas $\mathbf{138}_0$ to $\mathbf{138}_6$ are further chosen with respect to the position depending on the expected frequency error, namely such that the same comprise a predetermined distance depending on the expected frequency error in the line direction. Two errors succeeding each other and/or arranged adjacently to each other in the line direction should comprise a distance which is smaller or equal to the predetermined distance, with the same being defined, as a rule, depending on the assumed error when sampling in a corresponding number of pixels.

Further, the areas are preferably chosen such that image areas are determined here, in which the best sample phase may be determined most easily, which is eg very simple in areas having a high contrast. As may be seen from FIG. 3, it is not necessarily required that all measuring areas $\mathbf{138}_0$ to $\mathbf{138}_6$ are associated with the same line of the image. Also, these may actually be arranged in different lines, as is represented in the concrete case of application.

For example, in the areas $\mathbf{138}_0$ to $\mathbf{138}_6$ determined in FIG. 3, a best sample phase will now be determined in accordance with the invention. The best sample phase will be determined with the method to be described in detail below.

A so-called reference value RV will be calculated across the established areas $\mathbf{138}_0$ to $\mathbf{138}_6$ of the repetitive area of the digitized input signal. For the same sub-areas—as the analog signal repeats itself—the pertaining reference values will be determined with various sample phases. In this case, the control 126 (see FIG. 2) is operative, so as to keep the frequency control signal constant at output 130 and to provide various phase-shift signals for various calculating sections at output 132. For the best phase-setting in an area the maximum or greatest reference value will result, whereas for the worst phase-setting, the minimum/lowest reference value will result.

The reference value may be calculated from the sum of the absolute difference of two succeeding sample values of all sample values in one of the measuring areas. The measuring area may be small up to a measurement of two sample values and extend itself across several lines of a frame.

The reference value may be calculated in accordance with the following calculating rule:

$$RV = \sum_n |X_n - X_{n+1}|$$

RV=reference value, n=number of sample values in the area considered, x=intensity value of a sampled pixel.

Thus, this reference value is a value becoming greater as the contrast increases. The best sample phase is a sample phase where the contrast assumes a highest/maximum value. The advantage of the previously described method for reference value calculation consists in that no line or image storage is required, so as to recognize whether the contrast becomes better or worse as the phase changes.

In order to express small differences, e.g. analog noise, it may be specified to sum up only those differences which are greater than a predetermined threshold value.

Figure 4:
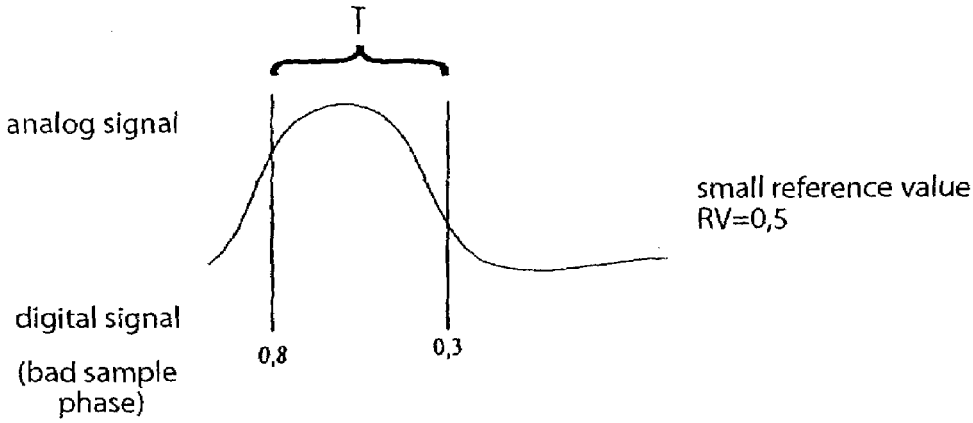
FIG. 4 is an example for the determination of a bad reference value (FIG. 4A) and a good reference value (FIG. 4B), which will be used for determining the sample phases.
Figure 4:
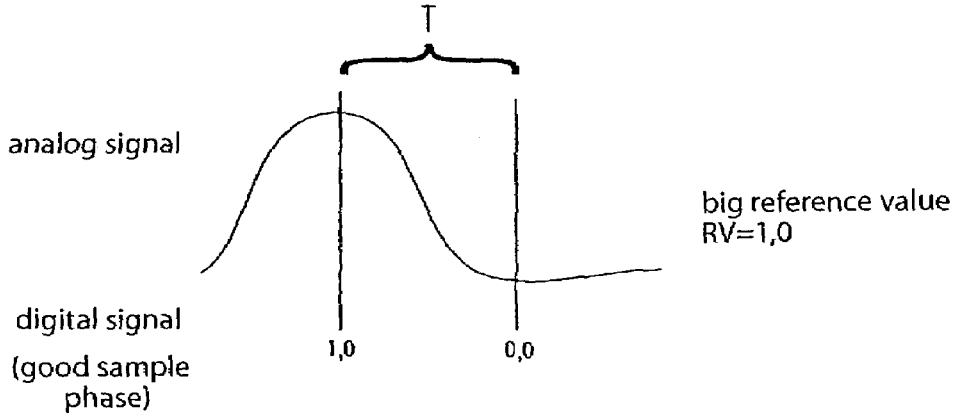

In FIG. 4, an example for the determination of a good or a bad reference value is represented. In FIG. 4A a sampling of the analog input signal with a fixed sampling frequency (see period T) is shown, in which the sample phase is chosen such that two adjacent digital values from 0.8 and 0.3 will result during sampling, which will lead to a reference value of 0.5.

In FIG. 4B, the sampling of the same analog signal with the same frequency (see period T) is represented, however, with a sample phase resulting in a digital sample value of 1.0 and an adjacent sample value of 0.0, such that a great reference value of RV of 1.0 results, which reflects a high contrast between two sampled points in the analog signal.

In FIG. 4A, thus, a sampling with a bad sample phase is represented, and in FIG. 4B the sampling is represented with a good sample phase. Assuming that the reference value achievable in FIG. 4B is the maximum reference value, the same will then be taken as a basis for the further method for the considered area. In one embodiment of the present invention, in which, instead of the best sample phase, the worst sample phase would be used, the reference value determined in FIG. 4A would be further used as a minimum reference value instead of the reference value determined in FIG. 4B.

In an alternative embodiment, various measurements may be carried out for the same sub-areas with the same phase-setting so as to obtain a plurality of reference values for each of the areas. In each area, the differences of the various reference values will then be formed. A maximum difference value shows the worst phase-setting in one area, and a minimum difference value shows the best phase-setting in one area. The reason for this is the sample clock jitter, since the analog signal changes the least in the area of the best sampling, so the least difference will result there. To put it more precisely, in this embodiment, a first measurement will first be carried out in accordance with the invention in each of the considered areas at an established sample phase and an established frequency. Subsequently, a second measurement will be carried out in each of the considered areas. Subsequently, a generation of the difference of the measured values obtained by the first and the second measurement will be effected. The previous steps will be repeated at various phase-settings so as to obtain a plurality of difference values from which the maximum difference value indicating a minimum contrast or the minimum difference value indicating a maximum contrast value are selected for each area.

Figure 5:
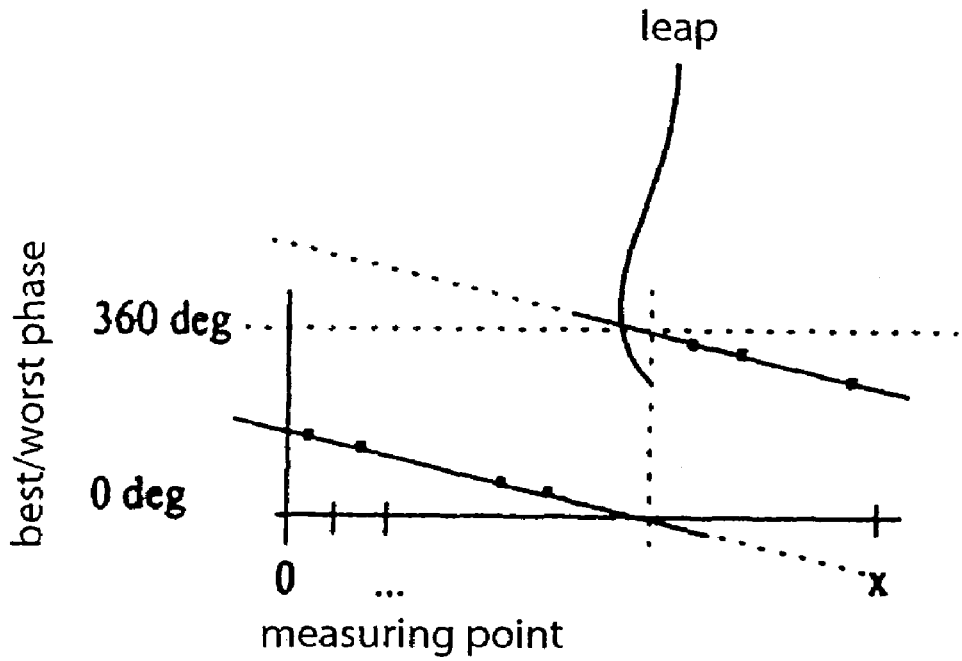
FIG. 5 is the local course of the best sample phases for the plurality of areas in FIG. 3.

After the best sample phase or worst sample phase was generated and determined for each of the areas, the frequency determination will now be carried out based on the thus detected sample phases. For this purpose, the obtained measured values will be represented in graphic form in a coordinate system. For this, as is shown in FIG. 5, the number of the mean sample value of the measuring area will be used as a x value (abscissa), and at the y-axis (ordinate) the determined sample phase will be plotted, which is associated with this area. Thus, for the considered sample values, the best/worst phase values plotted in FIG. 5 will result, which have been determined in the above-described manner.

The points plotted across the x-axis in this way, which concern the best sample phases, will then be connected to a straight line, as is shown in FIG. 5, and by means of known mathematical procedures, the slope S of the straight line will now be determined in degrees per sample value. For example, the slope will be determined in accordance with the following calculating rule:

$$S = \frac{\Delta\, deg}{\Delta x}$$

When calculating S, however, leaps must be considered in which the sample phase values leap between a minimum value (0 degrees) and a maximum value (360 degrees), as is indicated in FIG. 4.

After the slope of the straight line has been determined, the correct sampling frequency may be determined in accordance with the following calculating rule:

$$Mn = M + \Delta M \text{ with } \Delta M = INT\left(\frac{S \cdot M}{360\ deg} + 0{,}5\right)$$

where:

M=ideal sample value

ΔM=modification value

S=slope, and

Mn=corrected frequency value.

Alternatively, the corrected or right sampling frequency may also be determined in that the number of leaps is determined in the course of the sample phases in the M sample clocks. This value then corresponds to the absolute value of ΔM. The sign will be determined by establishing whether the straight line is rising or falling.

If the sampling frequency is correctly set, the sample phase will now result for each of the N areas.

While this invention has been described in terms of several preferred embodiments, there are alterations, permutations, and equivalents, which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

What is claimed is:

1. Apparatus for generating digital data from analog image data, so as to display an image based on the analog image data on a digital screen, and an ideal sampling frequency for re-sampling the analog image data being signalized to the digital screen, the apparatus comprising:

an A/D converter including a data input for receiving the analog image data, a data output for outputting the digital image data, and a clock input;

a clock generator including a clock output for outputting a clock signal, and a control input for receiving a clock frequency control signal;

a phase-shifter including a clock input for receiving the clock signal from the clock generator, a clock output for outputting a phase-shifted clock signal to the clock input of the A/D converter, and a control terminal for receiving a control signal establishing a phase-shift; and a control having an input for receiving the digital data from the A/D converter, a first control output for outputting the clock frequency control signal to the clock generator, and a second control output for outputting the signal establishing the phase-shift to the phase-shifter, with the control means being operative in order to select a new sampling frequency on the basis of the ideal sampling frequency signalized to the digital screen, to control the clock generator via the clock frequency control signal to output a clock signal with the new sampling frequency, and to carry out the following steps based on the digital data provided at the input, establishing at least two areas succeeding in line direction in the image to be displayed, multiple sampling of each of the areas at the new sampling frequency with respective different phases, wherein the sampling frequency is fixed, for each of the areas determining the sample phase for the different sample phases, for which a contrast in the area is a maximum or a minimum, determining a local course of the sample phases of the areas provided in the line direction based on the sample phase determined for each area, deriving a modification value from the local course of the sample phase, modifying the ideal sampling frequency by the modification value to obtain a proper sampling frequency for the analog image data, and generating the clock frequency control signal corresponding to the proper sampling frequency.

2. Apparatus in accordance with claim 1, wherein the control for determining the sample phase in each of the areas effects a plurality of samples of each area, so as to obtain a plurality of reference values for each of the areas, which is defined by the absolute difference of at least two succeeding intensity values, with the control, during the plurality of samples, changing the signal indicating the phase-shift at each sample and keeping the clock frequency control signal constant, and wherein the control selects a maximum reference value or a minimum reference value for each value from the plurality of the obtained reference values.

3. Apparatus in accordance with claim 2, wherein the control means is further operative in order to carry out plural sampling of each of the at least two areas at a fixed sampling frequency at different sampling phases to determine in each of the areas a sample phase, for which a contrast in the established area is a maximum or a minimum.

4. Apparatus in accordance with claim 1, wherein the control for determining the sample phase is operative, so as to carry out a first measurement in each of the considered areas at an established sample phase and an established sampling frequency, so as to obtain a first reference value, carry out a second measurement in each of the considered areas at an established sample phase and an established sampling frequency, so as to obtain a second reference value, repeat the first measurement and the second measurement at various phase-settings, and select for each of the considered areas the maximum difference value indicating a minimum contrast or the minimum difference value indicating a maximum contrast from the plurality of obtained difference values.

5. Apparatus in accordance with claim 4, wherein the control means is further operative in order to carry out plural sampling of each of the at least two areas at a fixed sampling frequency at different sampling phases to determine in each of the areas a sample phase, for which a contrast in the established area is a maximum or a minimum.

6. Apparatus in accordance with claim 1, wherein the control means is further operative in order to carry out plural sampling of each of the at least two areas at a fixed sampling frequency at different sampling phases to determine in each of the areas a sample phase, for which a contrast in the established area is a maximum or a minimum.

* * * * *